US006942044B2

(12) United States Patent
Moore et al.

(10) Patent No.: US 6,942,044 B2
(45) **Date of Patent: *Sep. 13, 2005**

(54) THREE-DIMENSIONAL STEERING TOOL FOR CONTROLLED DOWNHOLE EXTENDED-REACH DIRECTIONAL DRILLING

(75) Inventors: N. Bruce Moore, Aliso Viejo, CA (US); R. Ernst Krueger, Houston, TX (US); Ronald E. Beaufort, Laguna Niguel, CA (US)

(73) Assignee: Western Well Tools, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/697,575

(22) Filed: Oct. 30, 2003

(65) Prior Publication Data

US 2004/0084219 A1 May 6, 2004

Related U.S. Application Data

(62) Division of application No. 10/282,481, filed on Oct. 28, 2002, now Pat. No. 6,708,783, which is a continuation of application No. 09/549,326, filed on Apr. 13, 2000, now Pat. No. 6,470,974.

(60) Provisional application No. 60/129,194, filed on Apr. 14, 1999.

(51) Int. Cl.[7] ..... E21B 47/024; E21B 4/02; E21B 4/64

(52) U.S. Cl. ..... 175/45; 175/26; 175/74; 166/255.2

(58) Field of Search ..... 73/152.43, 152.45, 73/152.46, 152.51; 166/50, 65.1, 117.5, 153, 250.01, 255.1, 255.2; 175/26, 40, 45, 50, 73, 74, 320

(56) References Cited

U.S. PATENT DOCUMENTS

| | | | |
|---|---|---|---|
| 3,285,350 | A | 11/1966 | Henderson |
| 4,076,084 | A | 2/1978 | Tighe |
| 4,454,598 | A | 6/1984 | Claycomb |
| 4,462,469 | A | 7/1984 | Brown |
| 4,597,454 | A | 7/1986 | Schoeffler |
| 4,612,987 | A | 9/1986 | Cheek |

(Continued)

FOREIGN PATENT DOCUMENTS

| | | |
|---|---|---|
| DE | 29 11 419 C2 | 11/1980 |
| DE | 34 03 239 C1 | 6/1985 |

(Continued)

*Primary Examiner*—Jennifer H Gray
(74) *Attorney, Agent, or Firm*—Christie, Parker & Hale, LLP

(57) ABSTRACT

A steering tool for extended-reach directional drilling in three dimensions comprises a mud pulse telemetry section, a rotary section, and a flex section assembled as an integrated system in series along the length of the tool. The flex section comprises a flexible drive shaft and a deflection actuator for applying hydraulic pressure along the length of the shaft for bending the shaft when making inclination angle adjustments during steering. The rotary section comprises a rotator housing coupled to the deflection housing for rotating the deflection housing for making azimuth angle adjustments during steering. The onboard mud pulse telemetry section receives inclination and azimuth angle steering commands together with actual inclination and azimuth angle feedback signals during steering for use in controlling operation of the flex section and rotary section for steering the tool along a desired course. The steering tool can change inclination and azimuth angles either simultaneously or incrementally while rotary drilling.

11 Claims, 15 Drawing Sheets

U.S. PATENT DOCUMENTS

| | | | |
|---|---|---|---|
| 4,828,050 | A | 5/1989 | Hashimoto |
| 4,854,397 | A | 8/1989 | Warren et al. |
| 4,928,776 | A | 5/1990 | Falgout, Sr. |
| 5,096,003 | A | 3/1992 | Kinnan |
| 5,139,094 | A | 8/1992 | Prevedel et al. |
| 5,163,521 | A | 11/1992 | Pustanyk et al. |
| 5,172,765 | A | 12/1992 | Sas-Jaworsky et al. |
| 5,186,264 | A | 2/1993 | du Chaffaut |
| 5,220,963 | A | 6/1993 | Patton |
| 5,332,048 | A | 7/1994 | Underwood et al. |
| 5,341,886 | A | 8/1994 | Patton |
| 5,343,964 | A | 9/1994 | Leroy |
| 5,410,303 | A | 4/1995 | Comeau et al. |
| 5,421,421 | A | 6/1995 | Appleton |
| 5,439,064 | A | 8/1995 | Patton |
| 5,443,129 | A | 8/1995 | Bailey et al. |
| 5,458,208 | A | 10/1995 | Clarke |
| RE35,790 | E | 5/1998 | Pustanyk et al. |
| 5,752,572 | A | 5/1998 | Baiden et al. |
| 5,758,732 | A | 6/1998 | Liw |
| 5,806,615 | A | 9/1998 | Appleton |
| 6,003,606 | A | 12/1999 | Moore et al. |
| 6,082,461 | A | 7/2000 | Newman et al. |
| 6,088,294 | A | 7/2000 | Leggett, III et al. |
| 6,089,332 | A | 7/2000 | Barr et al. |
| 6,092,610 | A | 7/2000 | Kosmala et al. |
| 6,105,690 | A | 8/2000 | Biglin, Jr. et al. |
| 6,109,370 | A | 8/2000 | Gray |
| 6,109,372 | A | 8/2000 | Dorel et al. |
| 6,158,529 | A | 12/2000 | Dorel |
| 6,206,108 | B1 | 3/2001 | MacDonald et al. |
| 6,241,031 | B1 | 6/2001 | Beaufort et al. |
| 6,244,361 | B1 | 6/2001 | Comeau et al. |

FOREIGN PATENT DOCUMENTS

| | | |
|---|---|---|
| DE | 37 04 077 A1 | 8/1987 |
| DE | 39 39 538 C1 | 6/1991 |
| DE | 40 37 262 C2 | 5/1992 |
| EP | 0 204 474 A1 | 5/1986 |
| EP | 0 209 217 A2 | 1/1987 |
| EP | 0 209 318 B1 | 1/1987 |
| EP | 0 256 796 B1 | 2/1988 |
| EP | 0 377 373 B1 | 7/1990 |
| EP | 0 497 420 A1 | 8/1992 |
| EP | 0 594 418 A1 | 4/1994 |
| EP | 0 624 706 A2 | 11/1994 |
| EP | 0 677 640 A1 | 10/1995 |
| EP | 0 774 563 A2 | 5/1997 |
| EP | 0 775 802 A2 | 5/1997 |
| EP | 0 806 542 A2 | 11/1997 |
| EP | 0 911 483 A2 | 4/1999 |
| WO | WO 92/14027 | 8/1992 |
| WO | WO 92/14905 | 9/1992 |
| WO | WO 92/21848 | 12/1992 |
| WO | WO 93/12318 | 6/1993 |
| WO | WO 93/12319 | 6/1993 |
| WO | WO 96/31679 | 10/1996 |
| WO | WO 96/37678 | 11/1996 |
| WO | WO 97/49889 | 12/1997 |

THREE-DIMENSIONAL STEERING TOOL FOR CONTROLLED DOWNHOLE EXTENDED-REACH DIRECTIONAL DRILLING

CROSS-REFERENCE TO RELATED APPLICATIONS

This application is a division of application Ser. No. 10/282,481, filed Oct. 28, 2002, now U.S. Pat. No. 6,708,783 which is a continuation of application Ser. No. 09/549,326, filed Apr. 13, 2000, now U.S. Pat. No. 6,470,974 which claims the priority of U.S. provisional application No. 60/129,194, filed Apr. 14, 1999. The entire disclosures of these applications are incorporated herein by reference.

FIELD OF THE INVENTION

This invention relates to the drilling of boreholes in underground formations, and more particularly, to a three-dimensional steering tool that improves extended reach directional drilling of boreholes.

BACKGROUND OF THE INVENTION

There is a need for drilling multiple angled, long reach boreholes from a fixed location such as from an offshore drilling platform. Historically, several methods have been used to change the direction of a borehole. With the requirement for multiple extended reach drilling of wells from offshore platforms came the need for a means for steering the drilling assembly more accurately. In the 1970s, the downhole motor and Measurement-While-Drilling (MWD) with a bent sub were introduced. Steering was accomplished by stopping rotary drilling and installing the downhole motor-bent sub assembly and an orientation tool. After making a trip into the borehole, the orienting tool was actuated and locked into the desired tool face angle—the angle of the assembly at the bottom of the hole similar to the points of a compass. The downhole motor's bent sub (typically with a two-degree bend) is actuated by increasing pump pressure, thus turning the motor and the drill bit. The assembly drills ahead with the drill string sliding forward and only the drill bit rotating, thus increasing the hole build angle approximately 2 degrees per length of the motor until the desired angle is achieved. It is during the sliding advancement of the drill string that differential sticking (a significant and frequently incurred problem) is most prevalent. The downhole motor is retrieved, thus requiring another trip to the surface. In later designs, after drilling the build section and when a short straight hole section is required, a trip to the surface can be delayed by rotating the bent sub downhole motor at drilling speeds (5–150 RPM) until the short straight section is drilled. This method can drill an approximately straight but slightly enlarged hole for short distances. The amount of time between trips is typically limited by the life of the downhole motor (80–100 hours), rather than the life of the bit (the preferred condition) which can be as high as 350–400 hours.

Thus, drilling with a downhole motor and a bent sub has disadvantages of being expensive and time consuming because of the trips in and out of the borehole when steering to each desired new angle, and this approach is unreliable because the downhole motor has a greater tendency to break down under these conditions.

Later, steering tools that were directly attached to the drill string were developed. Modern steering tools of this type are either discrete or integrated. Discrete steering tools include Halliburton's TRACS 2D, Maersk's "wall grabber" style tool, Directional Drilling Dynamics' tool that rotates through a bend, and the Cambridge Radiation tool that includes a non-rotating body that deflects the drill string.

Integrated steering tools are part of an assembly of other downhole tools including downhole sensors. Suppliers of these include Halliburton's TRACS 2D, Smith Red Barron which includes a non-rotating near bit stabilizer (Wall Grabber), and the ANADRILL tool that is being integrated into a Camco tool. Baker Hughes Inteq has the AUTO TRAK tool that includes directional resistivity and vibration measurements. Camco has a 3-D SRD tool with sensors that can perform five jobs without a major overhaul.

Certain prior art steering tools can change azimuth and inclination simultaneously. These tools, one of which is manufactured by Schlumberger, utilizes three pistons which extend laterally outwardly from the drill string at different distances to push the drill string off center to change orientation of the drill string. This approach avoids use of a bent sub. However, use of pistons in a small diameter drill hole to make steering adjustments is not desirable; and they are costly and less reliable because of the large number of mechanical parts.

The previously mentioned MWD system is a separate standalone assembly comprising survey equipment which uses an inclinometer or accelerometer for measuring inclination and a magnetometer for measuring azimuth angle. Inclination angle is typically measured away from vertical (90 degrees from the horizontal plane), and azimuth angle is measured as a rotational angle in a horizontal plane, with magnetic North at zero degrees and West at 270 degrees, for example.

There is a need for a low cost, highly reliable, long life three-dimensional rotary drilling tool that provides steering in both azimuth and inclination while drilling. It is also desirable to provide a steering tool which can change both inclination and azimuth angles without use of a downhole motor and bent sub and the time consuming and expensive trips to the surface for changing orientation of the steering tool. It would also be desirable to avoid use of wall grabber type systems that require contact with the wall of the borehole to push the drill string off center in order to change drilling angles.

The present invention provides a steering tool which can change inclination and azimuth angles either continuously (simultaneously) or incrementally while rotary drilling and while making such steering adjustments in three dimensions. Changes in inclination and azimuth while rotary drilling can be made with drilling fluid flowing through the drill string and up the bore. The steering assembly of this invention can respond to electrical signals via onboard mud pulse telemetry to control the relative azimuth and inclination angles throughout the drilling process. Such three dimensional steering can be achieved without stopping the drilling process, without use of a downhole motor or bent sub, and without borehole wall contacting devices that externally push the drill string toward a desired orientation. The invention provides a steering tool having lower cost, greater reliability, and longer life than the steering tools of the prior art, combined with the ability to improve upon long reach angular drilling in three dimensions with reduced torque and drag.

SUMMARY OF THE INVENTION

Briefly, one embodiment of the invention comprises a three-dimensional steering tool for use in drilling a borehole in an underground formation in which an elongated conduit extends from the surface through the borehole and in which the steering tool is mounted on the conduit near a drill bit for drilling the borehole. The steering tool comprises an integrated telemetry section, rotary section and flex section. The steering tool includes an elongated drive shaft coupled between the conduit and the drill bit. The flex section includes a deflection actuator for applying a lateral bending force to the drive shaft for making inclination angle adjustments at the drill bit. The rotary section includes a rotator actuator for applying a rotational force transmitted to the drive shaft for making azimuth angle adjustments at the drill bit. The telemetry section measures inclination angle and azimuth angle during drilling and compares them with desired inclination and azimuth angle information, respectively, to produce control signals for operating the deflection actuator to make steering adjustments in inclination angle and for operating the rotator actuator for making steering adjustments in azimuth angle.

In another embodiment of the invention, the flex section includes an elongated drive shaft coupled to the drill bit, and a deflection actuator for hydraulically applying a lateral bending force lengthwise along the drive shaft for making changes in the inclination angle of the drive shaft which is transmitted to the drill bit as an inclination angle steering adjustment. The rotary section is coupled to the drive shaft and includes a rotator housing for transmitting a rotational force to the drive shaft to change the inclination angle of the drive shaft which is transmitted to the drill bit as an azimuth angle steering adjustment. The telemetry section includes sensors for measuring the inclination angle and azimuth angle of the steering tool while drilling. Command signals proportional to the desired inclination angle and azimuth angle of the steering tool are fed to a feedback loop for processing measured and desired inclination angle and azimuth angle data for controlling operation of the deflection actuator for making inclination angle steering adjustments and for controlling operation of the rotator actuator for making azimuth angle steering adjustments.

In an embodiment of the invention directed to rotary drilling applications, a rotary drill string extends from the surface through the borehole, and the steering tool is coupled between the rotary drill string and a drill bit at the end for drilling the borehole. The steering tool includes an elongated drive shaft coupled between the drill string and the drill bit for rotating with rotation of the drill string when drilling the borehole. The flex section comprises a deflection actuator which includes a deflection housing surrounding the drive shaft and an elongated deflection piston movable in the deflection housing for applying a lateral bending force lengthwise along the drive shaft during rotation of the drill string for changing the inclination angle of the drive shaft to thereby make inclination angle steering adjustments at the drill bit. The rotary section includes a rotator housing surrounding the drive shaft and coupled to the deflection housing. A rotator piston contained in the rotator housing applies a rotational force to the deflection housing to change the azimuth angle of the drive shaft during rotation of the drill string to thereby make azimuth angle steering adjustments at the drill bit. The telemetry section measures present inclination angle and azimuth angle during drilling and compares it with desired inclination and azimuth angle information to produce control signals for operating the deflection piston and the rotator piston to make steering adjustments in three dimensions.

The description to follow discloses an embodiment of the telemetry section in the form of a closed loop feedback control system. One embodiment of the telemetry section is hydraulically open loop and electrically closed loop although other techniques can be used for automatically controlling inclination and azimuth steering adjustments.

Although the description to follow focuses on an embodiment in which the steering tool is used in rotary drilling applications, the invention can be used with both rotary and coiled tubing applications. With coiled tubing a downhole mud motor precedes the steering tool for rotating the drill bit and for producing rotational adjustments when changing azimuth angle, for example.

In one embodiment in which inclination and azimuth angle changes are made simultaneously, the steering tool can include a packerfoot (gripper) for contacting the wall of the borehole to produce a reaction point for reacting against the internal friction of the steering tool, not the rotational torque of the drill string.

These and other aspects of the invention will be more fully understood by referring to the following detailed description and the accompanying drawings.

DETAILED DESCRIPTION OF THE INVENTION

Figure 1:
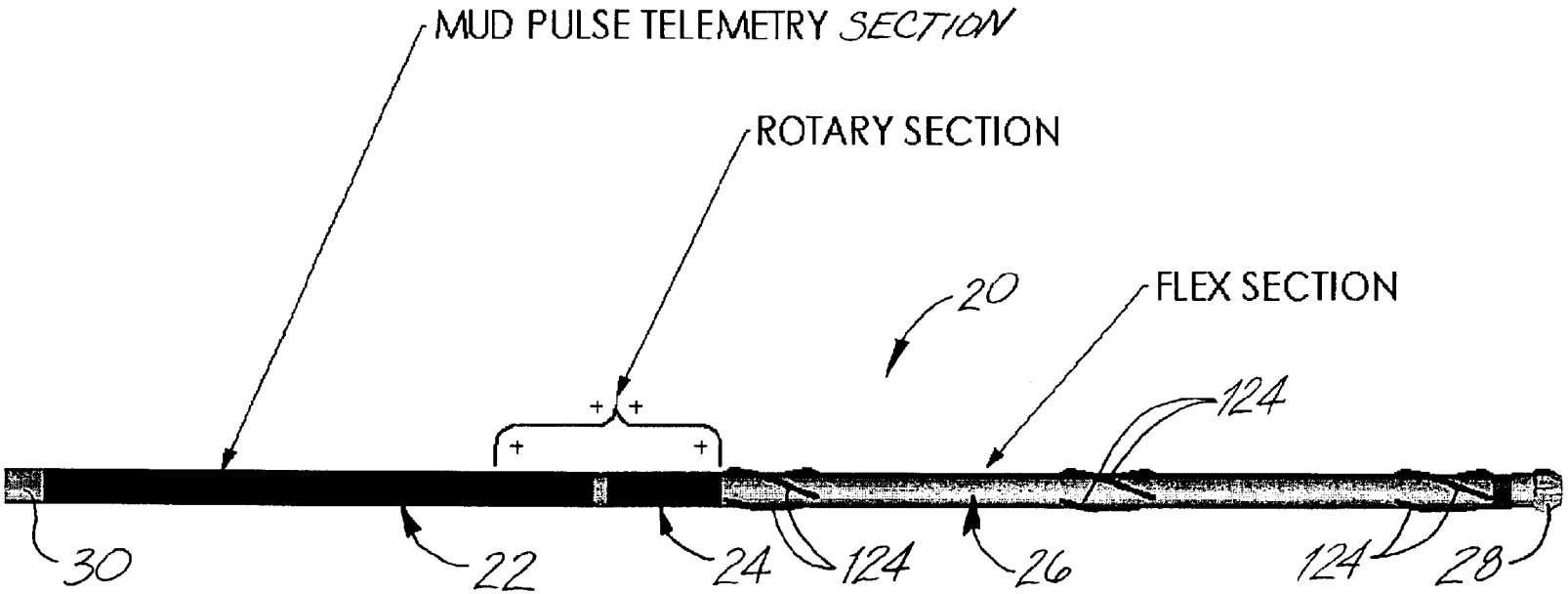
FIG. 1 is an elevational view showing the three dimensional steering tool of this invention.
Figure 2:
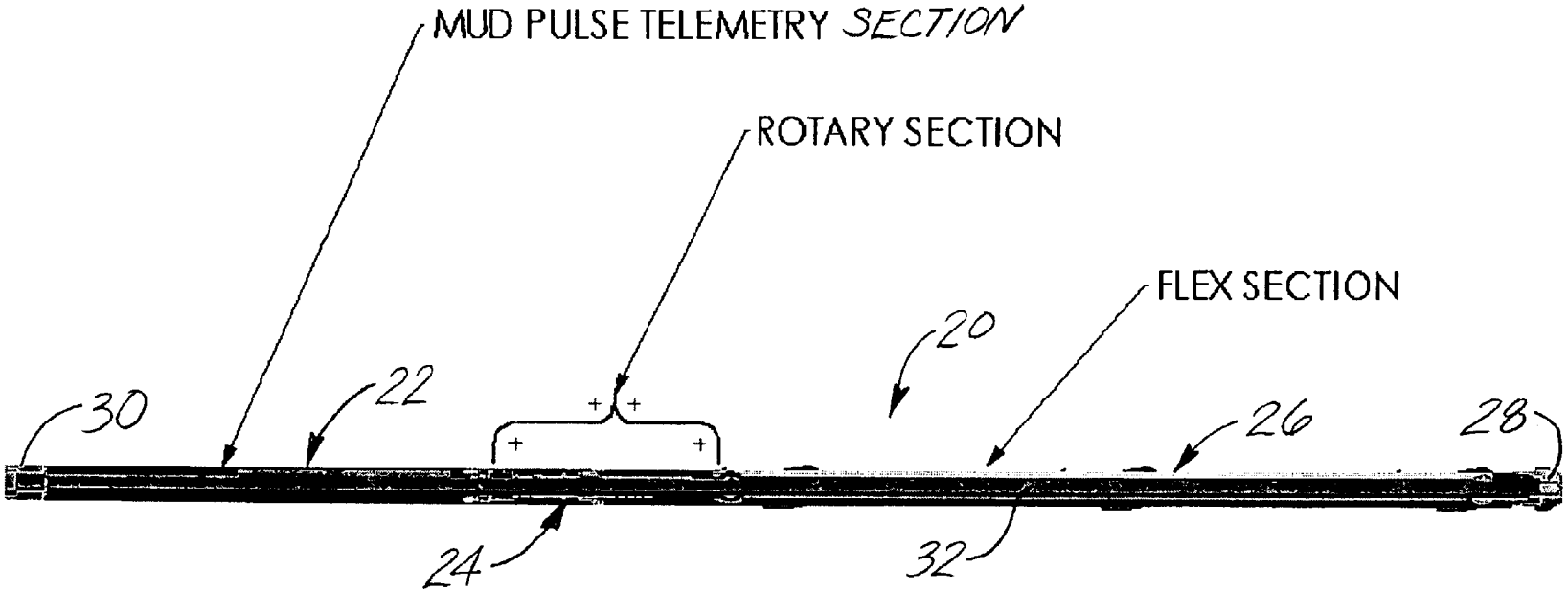
FIG. 2 is a view of the three dimensional steering tool similar to FIG. 1, but showing the steering tool in cross-section.

Referring to FIGS. 1 and 2, an integrated three dimensional steering tool 20 comprises a mud pulse telemetry section 22, a rotary section 24, and an inclination or flex section 26 connected to each other in that order in series along the length of the tool. The steering tool is referred to as an "integrated" tool in the sense that the flex section and rotary section of the tool, for making inclination angle and azimuth angle adjustments while drilling, are assembled on the same tool, along with a steering control section (the mud pulse telemetry section) which produces continuous measurements of inclination and azimuth angles while drilling and uses that information to control steering along a desired course. A drill bit 28 is connected to the forward end of the flex section. A coupling 30 at the aft end of the tool is coupled to an elongated drill string (not shown) comprising sections of drill pipe connected together and extending through the borehole to the surface in the well known manner. The inclination or flex section 26 provides inclination angle adjustments for the steering tool. The rotary section 24 provides azimuth orientation adjustments to the tool. The mud pulse telemetry section 22 provides command, communications, and control to the tool to/from the surface. The entire tool has an internal drilling bore 32, shown in FIG. 2, which allows drilling fluid (also referred to as "drilling mud" or "mud") to flow through the tool, through the drill bit, and up the annulus between the tool and the inside wall of the borehole. In the embodiment illustrated in FIGS. 1 and 2, a 6.5 inch diameter tool is used in an 8.5 inch diameter hole, and the tool is 224 inches long. Three dimensional steering is powered by differential pressure of the drilling fluid that is taken from the drill string bore and discharged into the annulus. A small portion (approximately 5% or less of the bore flow rate) is used to power the tool and is then discharged into the annulus.

The steering tool is controlled by the mud pulse telemetry section 22 and related surface equipment. The mud pulse telemetry section at the surface includes a transmitter and receiver, electronic amplification, software for pulse discrimination and transmission, displays, diagnostics, printout, control of downhole hardware, power supply and a PC computer. Within the tool are a receiver and transmitter, mud pulser, power supply (battery), discrimination electronics and internal software. Control signals are sent from the mud pulse telemetry section to operate onboard electric motors that control valves that power the rotary section 24 and the inclination or flex section 26. The steering tool is equipped with standard tool joint threaded connections to allow easy connection to conventional downhole equipment such as the drill bit 28 or drill collars.

Figure 3:
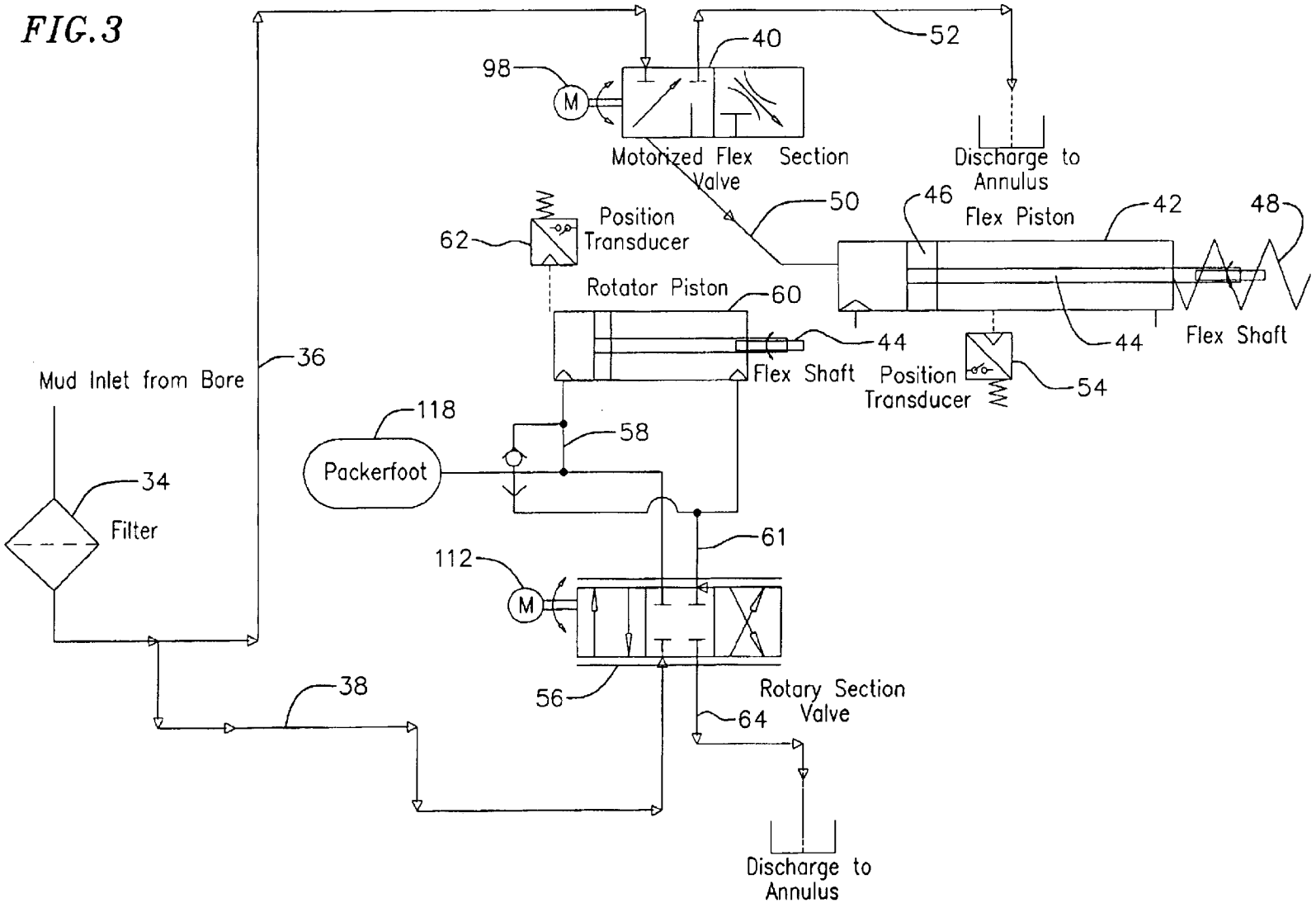
FIG. 3 is a schematic functional block diagram illustrating electrical and hydraulic components of the integrated control system for the steering tool.

FIG. 3 is a schematic functional block diagram illustrating one embodiment of an electro-hydraulic system for controlling operation of the flex section 26 and the rotary section 24 of the steering tool. Differential pressure of the drilling fluid between the drill string bore and the returning annulus is used to power the rotary and flex sections of the three-dimensional steering tool. This drilling fluid is brought into the drilling fluid control system from the annulus through a filter 34 and is then split to send the hydraulic fluid under pressure to the flex section 26 through an input line 36 and to the rotary section 24 through an input line 38. Drilling fluid from the flex section input line 36 enters an inlet side of a motorized flex section valve 40, preferably a three port/two position drilling fluid valve. When the flex section is operated to change the inclination angle of the steering tool the valve 40 opens to pass the drilling fluid to a deflection housing 42 schematically illustrated in FIG. 3. The deflection housing contains a flex shaft 44 which functions like a single-acting piston 46 with a return spring 48 as schematically illustrated. Drilling fluid passes through a line 50 from the inlet side of the valve 40 to a side of the deflection housing which applies fluid pressure to the piston section of the flex shaft for making adjustments in the inclination angle of the steering tool. After the tool has achieved the desired inclination, the flex section valve is shifted to allow drilling fluid to pass through a discharge section of the valve and drain to the annulus through a discharge line 52. Flex piston travel is measured by a position transducer 54 that produces instantaneous position measurements proportional to piston travel. These position measurements from the transducer are generated as a position feedback signal for use in a closed loop feedback control system (described below) for producing desired inclination angle adjustments during operation of the steering tool. The feedback loop from the flex position transducer to the flex valve's motor either maintains or modifies the valve position, thus maintaining or modifying the inclination angle of the tool.

For the rotary section, the drilling fluid in the input line 38 enters the inlet side of a rotary control valve 56, preferably a three position, four port drilling fluid valve. When the rotary section is operated to produce rotation of the steering tool, for adjustments in azimuth angle, the control valve 56 opens to pass drilling fluid through a line 58 to a rotator piston 60 schematically illustrated in FIG. 3. The rotator piston functions like a double-acting piston; it moves linearly but is engaged with helical gears to produce rotation of the deflection housing containing the flex piston. Drilling fluid enters the rotator piston which travels on splines to prevent the piston's rotation. The piston drives splines that rotate the deflection housing 42 and thus, the orientation of the flex shaft, which causes changes in the azimuth angle of the steering tool. Drilling fluid from the rotator piston is re-circulated back to the rotary section valve 56 through a return line 61. Piston travel of the rotator piston is measured by a rotary position transducer 62 that produces a position signal measuring the instantaneous position of the rotator piston. The rotary position signal is provided as a position feedback signal in a closed loop feedback control system described below. The feedback signal is proportional to the amount of travel of the rotator piston for use in producing desired rotation of the steering tool for making azimuth angle adjustments. After the steering tool has achieved the desired azimuth adjustment, the rotary section valve is shifted to allow the fluid to drain through a discharge line 64 to the annulus.

Figure 4:
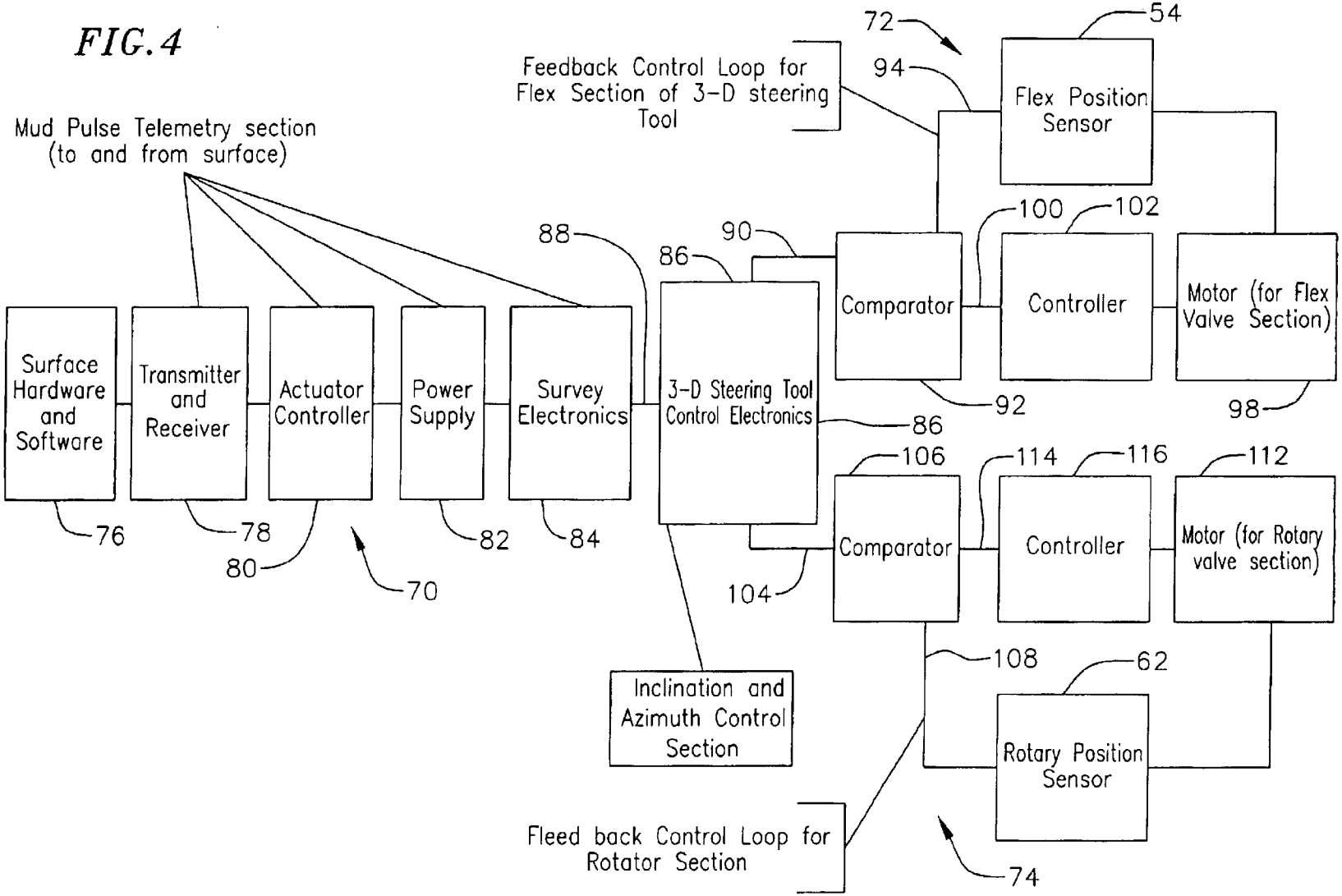
FIG. 4 is a functional block diagram showing the electronic components of an integrated inclination and azimuth control system for the steering tool.

FIG. 4 is a functional block diagram illustrating the electronic controls for operating the flex section and the rotary section of the steering tool. The control system is divided into three major sections—a mud pulse telemetry section 70, a feedback control loop 72 for the flex section of the steering tool, and a feedback control loop 74 for the rotator section of the tool.

The mud pulse telemetry section 70 includes surface hardware and software 76, a transmitter and receiver 78, an actuator controller 80, a power supply (battery or turbine generator) 82, and survey electronics with software 84. The survey equipment uses a inclinometer or accelerometer for measuring inclination angle and a magnetometer for measuring azimuth angle. The mud pulse telemetry receives inclination and azimuth data periodically, and the controller translates this information to digital signals which are then sent to the transmitter which comprises a mud pulse device which exhausts mud pressure into the annulus and to the surface. Standpipe pressure variations are measured (with a pressure transducer) and computer software is used to produce input signal information proportional to desired inclination and azimuth angles. The position of the tool is measured in three dimensions which includes inclination angles (tool face orientation and inclination) and azimuth angle. Tool depth is also measured and fed to the controller to produce the desired inclination and azimuth angle input data.

The mud pulse telemetry section includes 3-D steering tool control electronics 86 which receive data inputs 88 from the survey electronics 84 to produce steering input signals proportional to the desired inclination angle and azimuth angle. In the flex section controller 72, a desired inclination angle signal 90 is fed to a comparator 92 along with an inclination angle feedback signal 94 from the flex position transducer 54. This sensor detects positional changes from the flex section piston, as described above, and feeds that data back to the comparator 92 which periodically compares the feedback signal 94 with the desired inclination angle input signal 90 to produce an inclination angle error signal 100. This error signal is fed to a controller 102 which operates the flex section valve motor 98 for making inclination angle adjustments.

In the rotary section control loop 74 a desired azimuth angle signal 104 is fed to a comparator 106 along with a rotary position feedback signal 108 from the rotary position transducer 62. This sensor detects positional changes from the rotator section piston described above and feeds that position data back to the comparator 106 which compares the feedback signal 108 with the azimuth angle input signal 104 to produce an error signal 114 for controlling azimuth. The error signal 114 is fed to a controller 116 which controls operation of the rotary valve section motor 112 for making azimuth angle adjustments.

The flex position sensor 54, which is interior to the steering tool, measures how much the flex shaft is deflected to provide the position feedback information sent to the comparator. The rotary position sensor 62 measures how much the rotator piston is rotated. This sensor is located on the rotator piston and includes a magnet which moves relative to the sensor to produce an analog output which is fed back to the comparator 106.

A packerfoot 118 is actuated to expand into the annulus and make contact with the wall of the borehole in situations where changes in inclination angle and azimuth angle are made simultaneously. The packerfoot is described in more detail below. An alternative gripper mechanism can be used to assist the rotary section. One of these is the Flextoe Packerfoot, which has a multiplicity of flexible members (toes) that are deflected onto the hole wall by different mechanisms, including inflating a bladder, or lateral movement of a wedge-shaped element into the toe. These are described in U.S. patent application Ser. No. 09/453,996, incorporated herein by reference. These gripping elements may incorporate the use of a mandrel and splines that allow the gripper to remain in contact to the hole wall while the tool advances forward. Alternatively, the component can remain in contact with the hole wall and be dragged forward by the weight of the system. The design option to drag or allow the tool to slide relative to the gripper depends upon the loads expected within the tool for the range of operating conditions of azimuth and inclination angle change.

Figure 5:
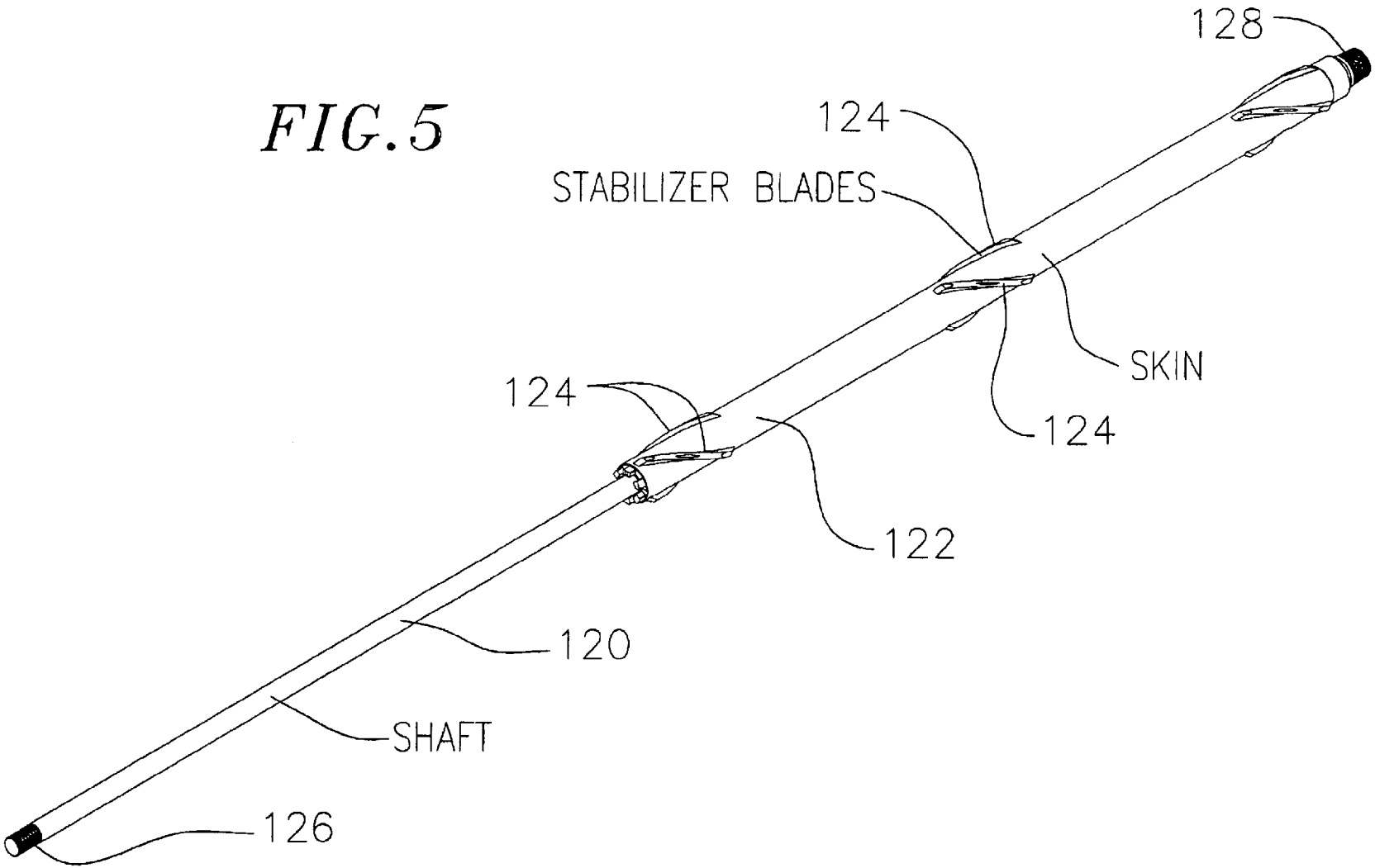
FIG. 5 is a perspective view showing a flex shaft component of the steering tool.

FIGS. 5 through 10 illustrate components of the flex section 26 of the steering tool. FIG. 5 is an external perspective view of the flex section which includes an elongated, cylindrical, axially extending hollow drive shaft 120 (also referred to herein as a flex shaft) extending the length of the flex section. The major components of the flex section are mounted to an aft section of the drive shaft and extend for about three-fourths the length of the shaft 120. In the external view of FIG. 5 the components include an elongated external skin 122 mounted concentrically around the shaft. The flex section components contained within the outer skin are described below. Helical stabilizer blades 124 project outwardly from the skin for contact with the wall of the borehole. A threaded connection 126 at the forward end of the drive shaft is adapted for connection to the drill bit 28 or to drill collars adjacent a drill bit. At the aft end of the flex section, a threaded connection 128 is adapted for connection to the rotary section of the steering tool.

Figure 6:
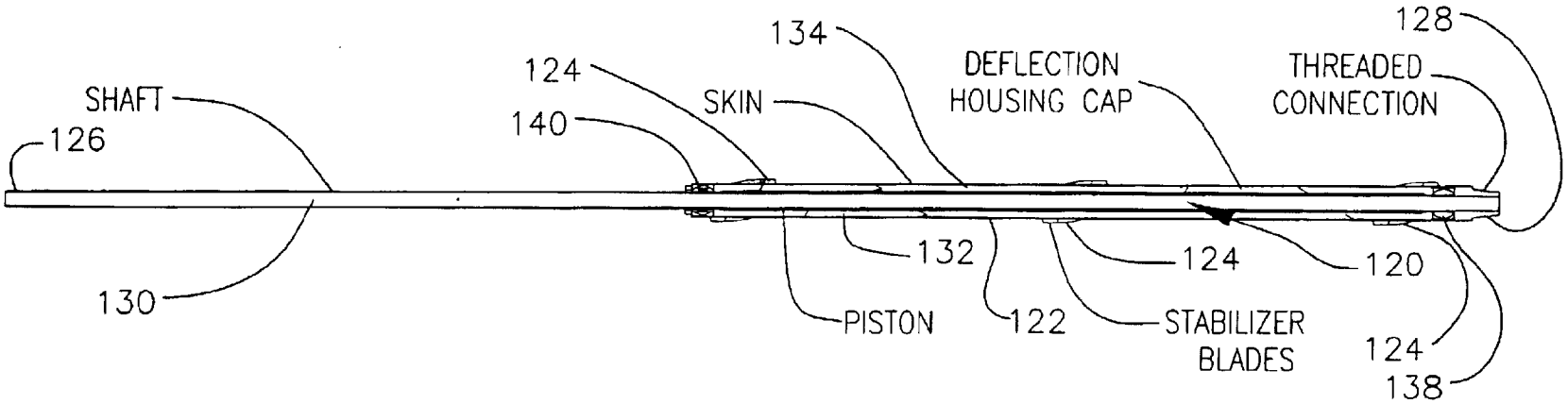
FIG. 6 is a cross-sectional view of the flex shaft shown in FIG. 5.

The cross-sectional view of FIG. 6 shows the drive shaft 120 running the length of the flex section, with a forward end section 130 of the drive shaft projecting axially to the exterior of the flex section components contained within the outer skin 122. This assembly of parts comprises a deflection actuator which includes an elongated deflection housing 132 extending along one side of the drive shaft, and an elongated deflection housing cap 134 extending along an opposite side of the drive shaft. The deflection housing and the deflection housing cap surround the drive shaft. An elongated deflection piston 136 is contained in the annulus between the drive shaft and the combined deflection housing and deflection housing cap. A forward end hemispherical bearing 140 and an aft end hemispherical bearing 138 join corresponding ends of the flex section components contained within the outer skin to the drive shaft. Alternatively, the hemispherical bearing on the aft end can be a constant velocity joint, either of commercially available type or specially designed.

Figure 7:
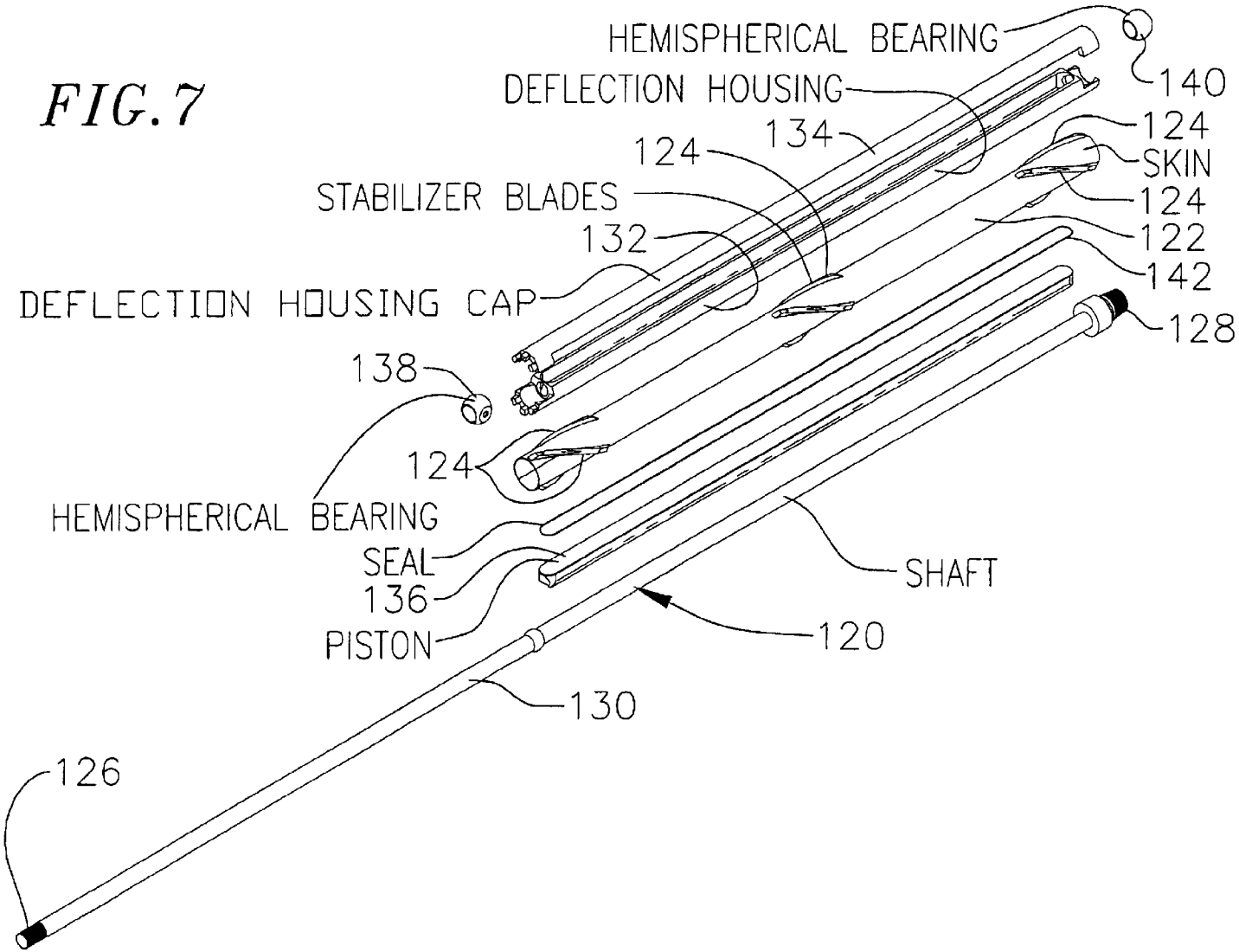
FIG. 7 is an exploded view shown in perspective to illustrate various components of a flex section of the steering tool.

The exploded perspective view of FIG. 7 illustrates internal components of the flex section. The deflection housing 132 has an upwardly opening generally U-shaped configuration extending around but spaced from the flex shaft. The deflection housing cap 134 is joined to the outer edges of the deflection housing to completely encompass the flex shaft 120 in an open space within the combined deflection housing and cap. The deflection piston 136 is mounted along the length of the flex shaft 120 to surround the flex shaft inside the deflection housing, but in some configurations may extend only over a portion of the length and its cap. The deflection piston extends essentially the entire length of the portion of the flex shaft contained in the deflection housing. A flat bottom surface of the deflection housing cap 132 joins to a cooperating flat top surface extending along the length of the deflection piston 136. FIG. 7 also shows one of two elongated seals 142 which seal outer edges of the deflection piston 136 to corresponding inside walls of the deflection housing.

Figure 8:
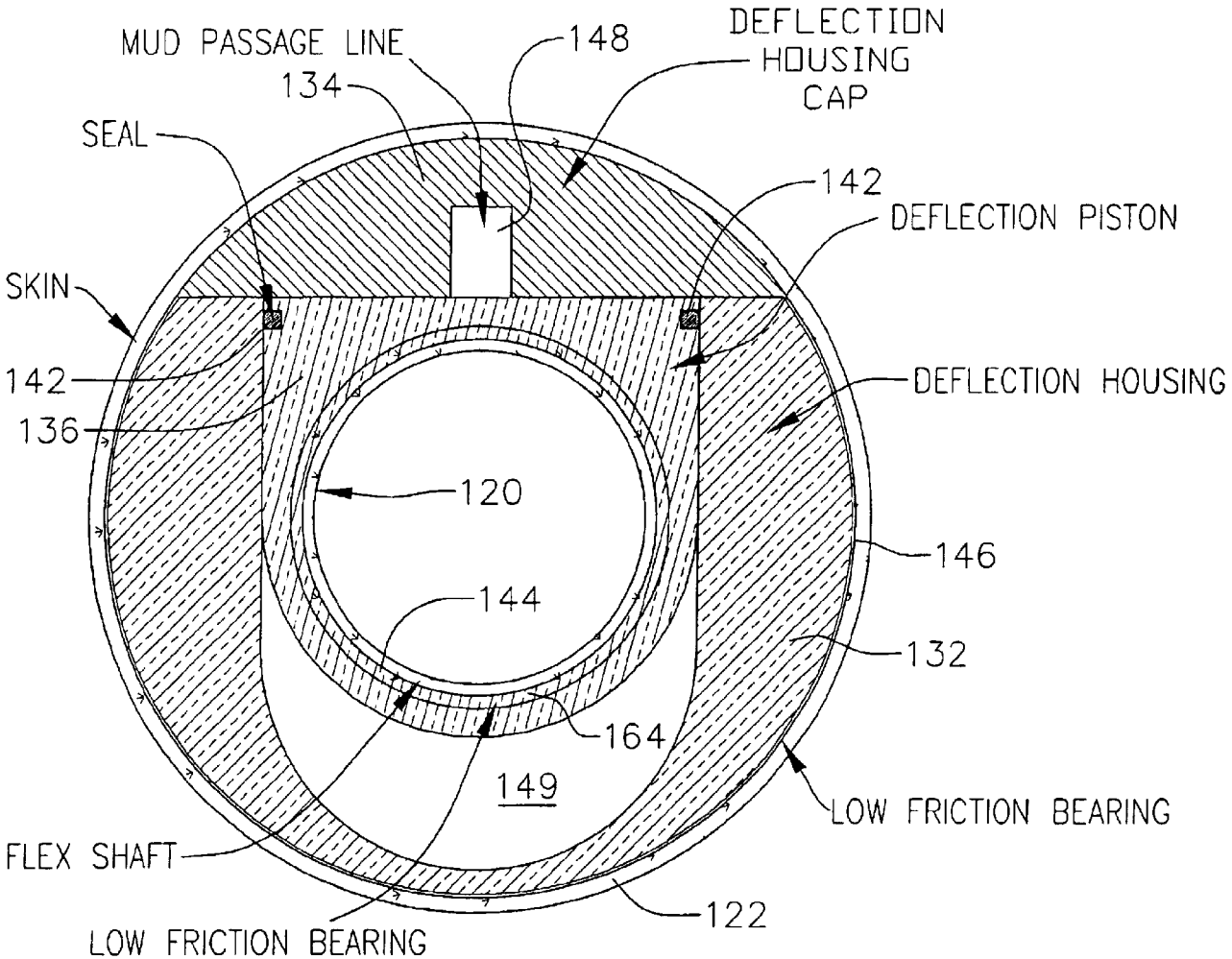
FIG. 8 is a cross-sectional view of the flex section of the steering tool in which the various components are assembled.

The cross-sectional view of FIG. 8 best illustrates how the components of the flex section are assembled. The hollow flex shaft 120 extends concentrically inside the outer skin 122 along a concentric longitudinal axis of the flex section. The deflection piston 136 surrounds the flex shaft in its entirety and is mounted on the flex shaft via an aligned cylindrical low-friction bearing 144. The U-shaped deflection housing 132 surrounds a portion of the flex shaft 120 and its piston 136, with flat outer walls of the piston bearing against corresponding flat inside walls of the U-shaped deflection housing. The longitudinal seals 142 seal opposite outer faces of the deflection piston to the inside walls of the deflection housing. The fixed deflection housing is mounted to the inside of the skin via an elongated low-friction bearing 146. A mud passage line 148 is formed internally within the deflection housing cap adjacent the top of the deflection piston. Drilling fluid under pressure in the passage is applied as a large pushing force to the top of the piston for deflecting the piston downwardly into the deflection housing. The passage extends the length of the piston to distribute the hydraulic pushing force along the length of the piston. Alternatively, the deflection piston may be used over a portion of the flex shaft. Deflection of the piston is downwardly into a void space 149 located internally below the piston and within the interior of the deflection housing. Deflection of the piston 136 has the effect of bending the flex shaft and thereby changing the angle of inclination at the end of the shaft (also referred to herein as a flex shaft deflection angle). This deflection of the flex shaft adjusts the inclination angle of the drill bit at the end of the steering tool. The region between the outer skin and both the deflection housing and the deflection housing cap has a low friction material that acts as a bearing.

The cross-sectional view of FIG. 8 best illustrates how the components of the flex section are assembled. The hollow flex shaft 120 extends concentrically inside the outer skin 122 along a concentric longitudinal axis of the flex section. The deflection piston 136 surrounds the flex shaft in its entirety and is mounted on the flex shaft via an aligned cylindrical low-friction bearing 144. The U-shaped deflection housing 132 surrounds a portion of the flex shaft 120 and its piston 136, with flat outer walls of the piston bearing against corresponding flat inside walls of the U-shaped deflection housing. The longitudinal seals 142 seal opposite outer faces of the deflection piston to the inside walls of the deflection housing. The fixed deflection housing is mounted to the inside of the skin via an elongated low-friction bearing 146. A mud passage line 148 is formed internally within the deflection housing cap adjacent the top of the deflection piston. Drilling fluid under pressure in the passage is applied as a large pushing force to the top of the piston for deflecting the piston downwardly into the deflection housing. The passage extends the length of the piston to distribute the hydraulic pushing force along the length of the piston. Alternatively, the deflection piston may be used over a portion of the flex shaft. Deflection of the piston is downwardly into a void space 149 located internally below the piston and within the interior of the deflection housing. Deflection of the piston 136 has the effect of bending the flex shaft and thereby changing the angle of inclination at the end of the shaft (also referred to herein as a flex shaft deflection angle). This deflection of the flex shaft adjusts the inclination angle of the drill bit at the end of the steering tool. The region between the outer skin and both the deflection housing and the deflection housing cap has a low friction material that acts as a bearing.

The relatively stiff deflection housing provides a structural reaction point for the internal flex shaft. The internal support structure provides a means for allowing the flex shaft to react against. As mentioned, the deflection piston runs the length of the flex section and the pressure is applied to the top of the piston to displace the flex shaft. The amount of this displacement of the deflection piston is greatest at its mid section between the hemispherical bearings at the ends of the flex section. The space is provided to allow the deflection piston to move or deflect within the deflection housing and this deflection varies along the length of the tool and is greatest at the midpoint between the hemispherical end bearings.

The flex shaft 120 rotates within the deflection piston 136. The region between the deflection housing and the flex shaft has its hydraulic bearing 164 lubricated either by mud (if in an open system which is preferred) or hydraulic oil (if sealed) and may include Teflon low friction materials. Pressure delivered between the deflection housing and the deflection piston (through the line 148) moves both the deflection piston and the flex shaft, while the flex shaft rotates with the drill string.

The reaction points for the skin and deflection housing are the multiple stabilizers 124 located on the forward and aft ends of the tool, although in one configuration a third set of stabilizers is located at the center, as shown in the drawings. The stabilizers may be either fixed or similar to a non-rotating style hydraulic bearing. The stabilizers cause the skin and the deflection housing to be relatively rigid compared to the flex shaft.

In one embodiment, the deflection housing and deflection housing cap are both made from rigid materials such as steel. The flex shaft, in order to facilitate bending, is made from a moderately high tensile strength material such as copper beryllium.

Figure 9:
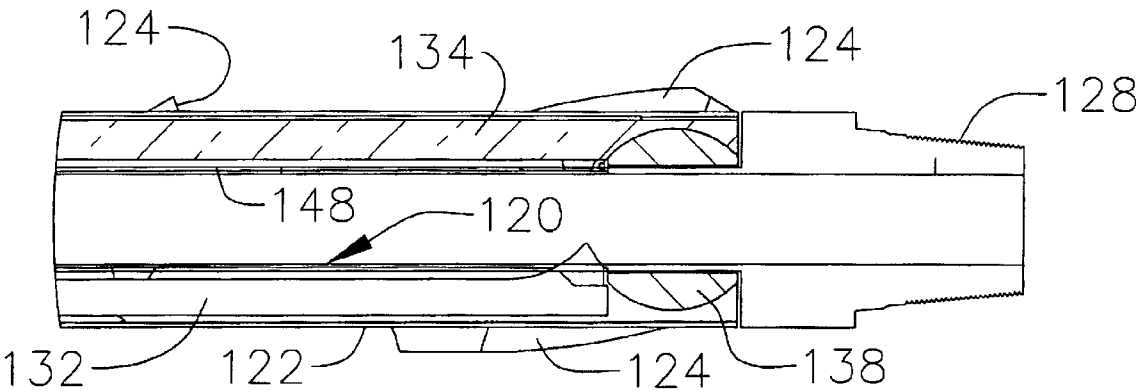
FIG. 9 is a fragmentary cross-sectional view showing a bearing arrangement at the forward end of the flex shaft component of the flex section.
Figure 10:
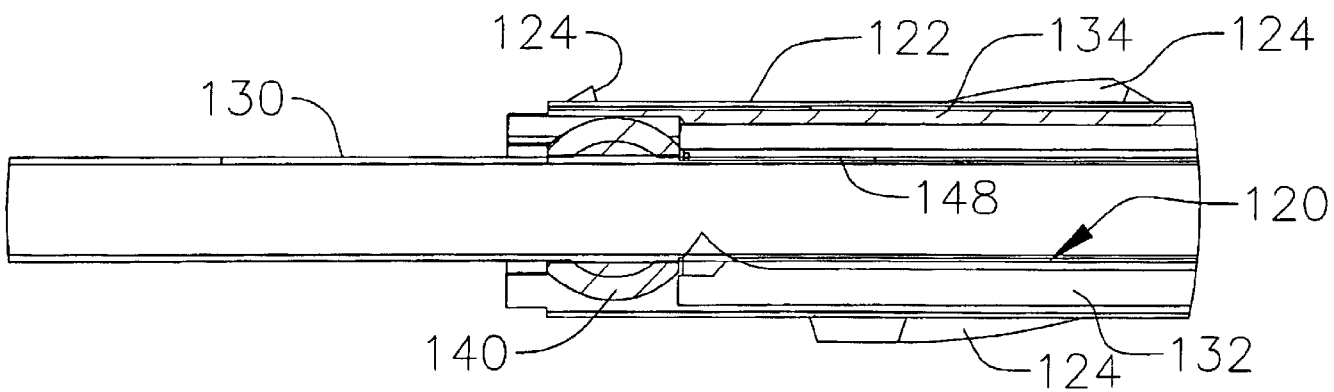
FIG. 10 is a fragmentary cross-sectional view showing a bearing arrangement at the aft end of the flex shaft component of the flex section.

FIGS. 9 and 10 show the aft and forward ends of the flex section, respectively, including the flex shaft 120, deflection piston, stabilizers 124, the outer skin 122 and the hemispherical bearings. FIG. 9 shows the hemispherical bearing 138 at the aft end of the flex section, and FIG. 10 shows the hemispherical bearing 140 at the forward end of the flex section. The bearings used to support the flex shaft can be various types, and preferably, the bearings rotate in a manner similar to a wrist joint. The hemispherical bearings shown can be sealed and lubricated or open to drilling fluid. The hemispherical bearings can be limited in deflection to less than 15 degrees (from horizontal) of deflection. Alternatively, constant velocity joints can be used. RMZ Inc. of Sterling Heights, Mich. produce a constant velocity joint with smooth uniform rotary motion with deflection capability up to 25 degrees. CV joints are low cost and efficiently transfer torque but will require that sealing from the drilling fluid.

Control for the flex section may be located in either the flex section or the rotary section but preferably in the rotary section. Again, the mud pulse telemetry is used to provide controls to the steering tool. Mud pulses are sent down the bore of the drill string, received by the mud pulse telemetry section, and then commands are sent to the flex and rotary sections. The flex section's electrical controls operate the electrical motor in a pressure compensated environment which controls the valve that delivers a desired drilling fluid pressure to the deflection housing, producing a desired change in inclination. The inclination angle changes produced by flexing the flex shaft and transmitted to the steering tool are at the end of the flex shaft.

The transducer used to measure deflection of the flex shaft or deflection housing provides feedback signals measuring the change in inclination of the tool as described previously. Other means of measuring flex shaft deflection can be used. Different types of displacement transducers can be used to determine the displacement of the shaft.

Significantly, because of this system design, the steering tool can be operated to change either inclination or azimuth separately and incrementally, or inclination or azimuth continuously and simultaneously, thus avoiding the downhole problem of differential sticking.

The aft end of the deflection housing is equipped with teeth that mesh into matching teeth in the rotary section. The joining of the deflection housing to the rotary section allows the rotary section to rotate the deflection housing to a prescribed location. The size and number of teeth can be varied depending upon tool size and expected deflection range of the flex section. The construction and operation of the rotary section is described as follows.

Figure 11:
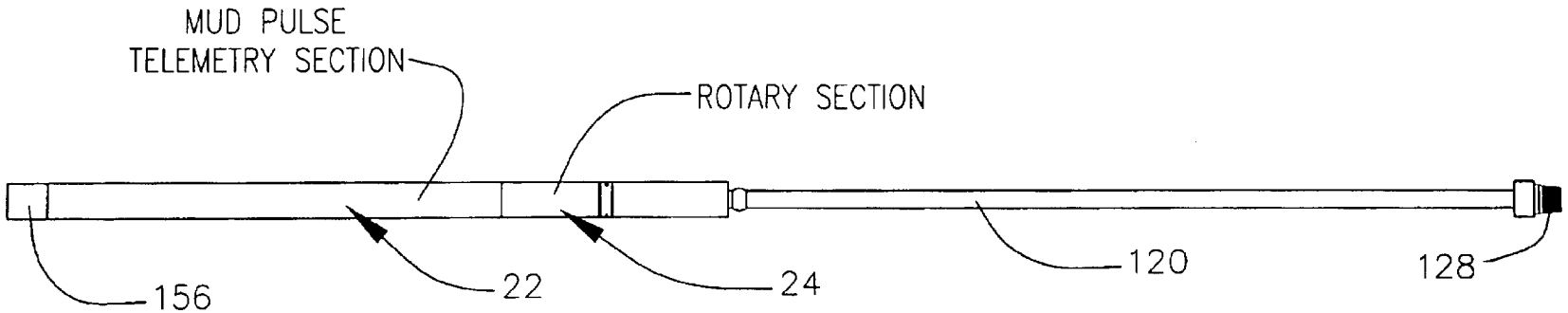
FIG. 11 is an elevational view showing a rotary section of the steering tool.
Figure 12:
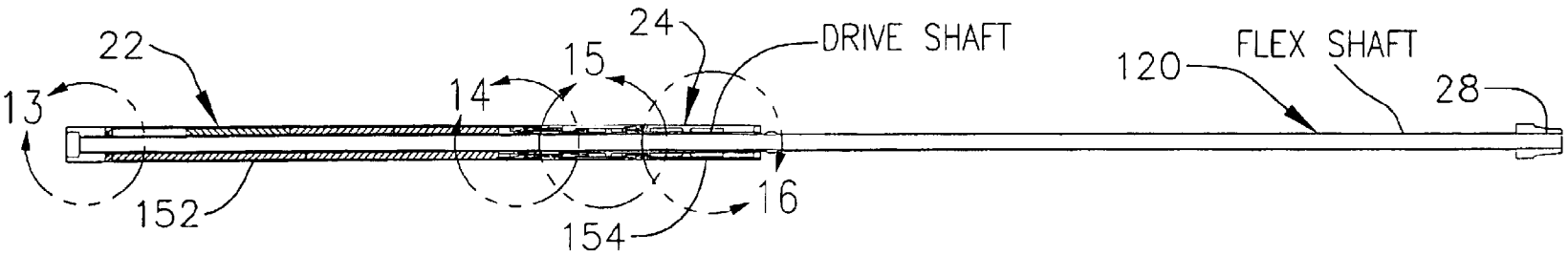
FIG. 12 is a cross-sectional view similar to FIG. 11 and showing the rotary section.
Figure 13:
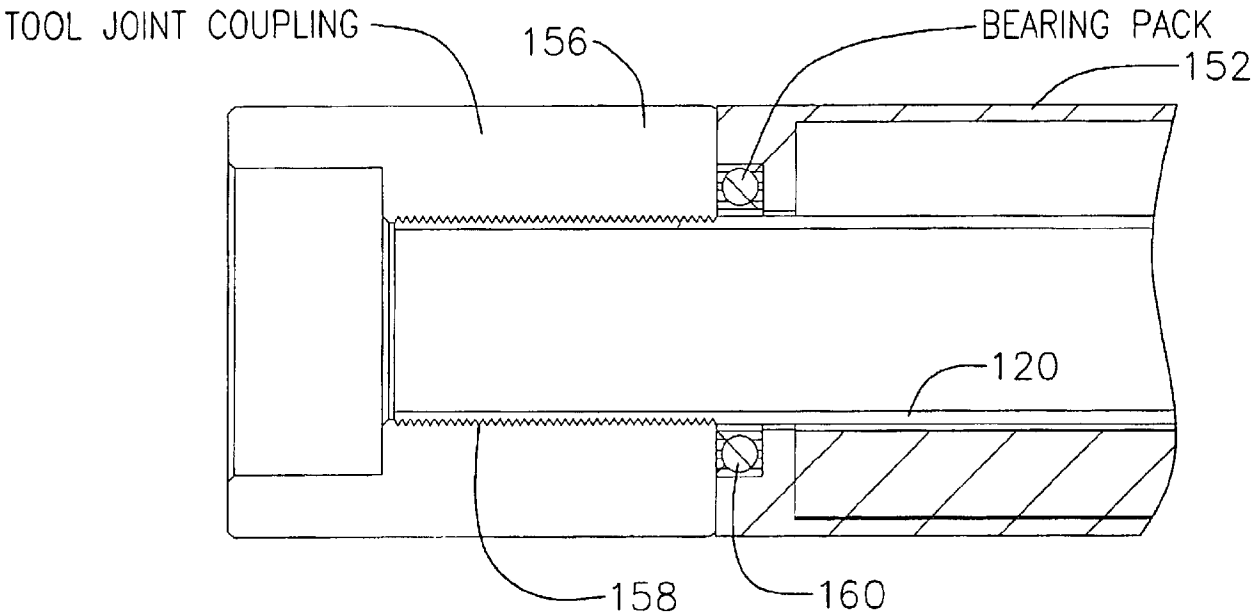
FIG. 13 is an enlarged fragmentary cross-sectional view taken within the circle 13—13 of FIG. 13.

FIGS. 11 and 12 show external and longitudinal cross-section views of the rotary section 24 of the steering tool, in its alignment between the flex shaft 120 and the mud pulse telemetry section 22. The cross-sectional view of FIG. 12 shows a mud pulse telemetry housing 152 concentrically aligned along the steering tool with the flex shaft 120 and a rotary section housing 154. The housing 154 is joined to the mud pulse telemetry housing 152 and is also aligned concentrically with the flex shaft 120. FIGS. 13 to 16 show detailed cross-sectional views of the rotary section from the aft end to forward end of the steering tool. Referring to FIG. 13, a tool joint coupling 156 connects to the drill string and delivers rotary motion to the flex shaft 120. A threaded end coupling 158 at the end of the flex shaft connects to the tool joint coupling 156. The tool joint coupling delivers rotary motion to the drive shaft and then through the hemispherical (or constant velocity) bearings to the flex shaft, the end of which is connected to the drill bit 28. A bearing pack 160 juxtaposed to the tool joint coupling prevents rotation from being delivered to the mud pulse telemetry housing 152 in response to rotation of the drill pipe and the flex shaft.

Figure 14:
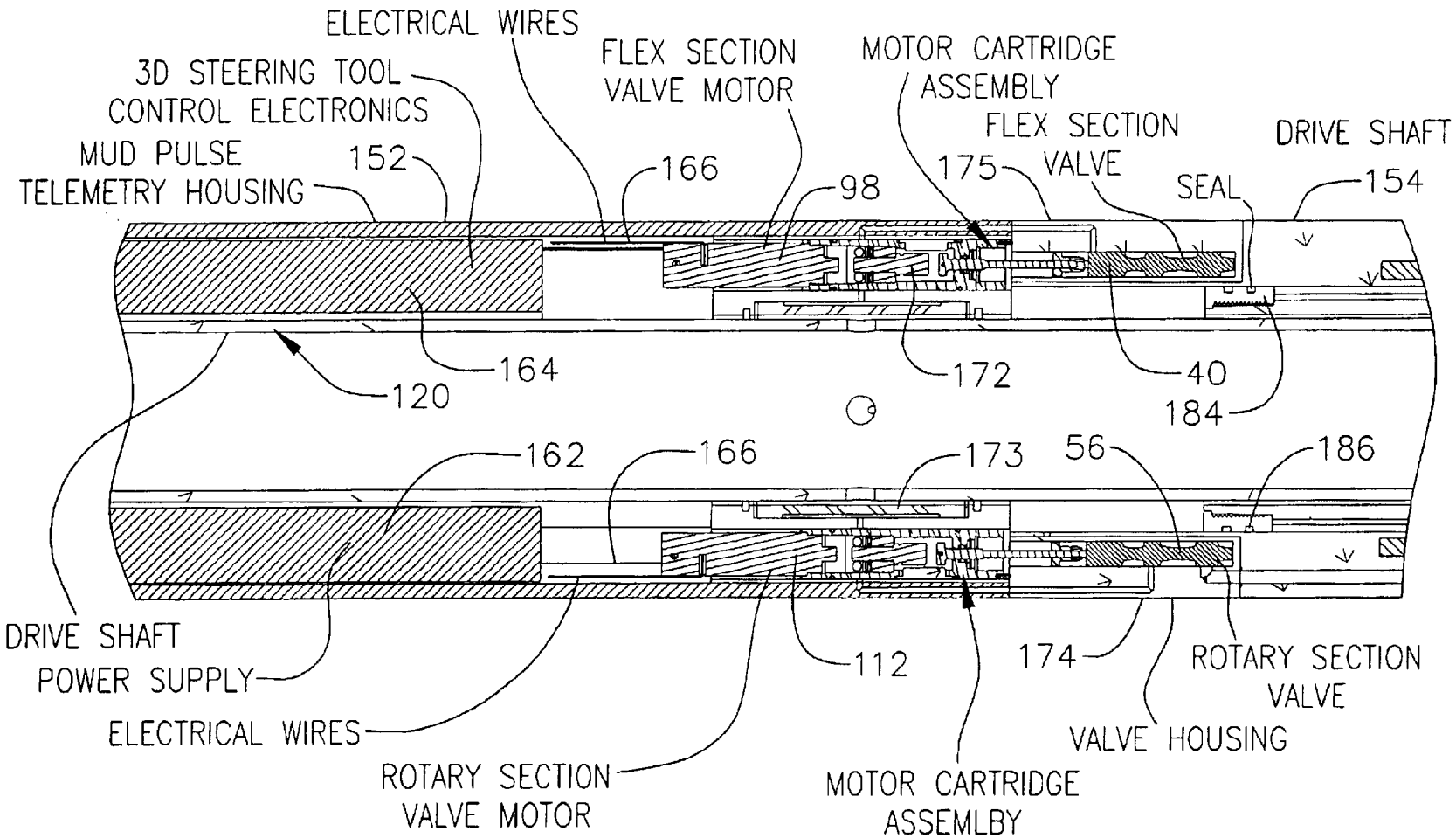
FIG. 14 is an enlarged fragmentary cross-sectional view taken within the circle 14—14 of FIG. 12.

Referring to FIG. 14, the mud pulse telemetry housing 152 contains the mud pulse telemetry transmitter, actuator/controller and survey electronics. The power supply 162 and steering tool electronics 164 are schematically shown in FIG. 14. These components are contained within an atmospherically sealed environment. Electrical lines 166 feed through corresponding motor housings and house the electric motors for the flex section control valve and the rotary section control valve. The electrical motors include the flex section valve motor 98 and the rotary section motor 112. The electrical motors may be either DC stepper or DC brushless type as manufactured by CDA Intercorp., Deerfield Beach, Fla. The motors are housed in a region containing hydraulic fluid, such as Royco 756 oil, from Royco of Long Beach, Calif. Electrical connectors, such as those manufactured by Greene Tweede & Co., Houston, Tex., connect the motors to the atmospheric chamber of the mud pulse telemetry electronics. The hydraulic fluid surrounding the motors is separated from the drilling fluid by a piston (not shown) for providing a pressure compensated environment to ensure proper function of the motors at extreme subterranean depths. The electric motors are connected to either the flex section control valve or to the rotary section control valve via a Western Well Tool-designed motor cartridge assembly 172. Drilling fluid is delivered to either the rotary section valve or to the flex section valve via fluid channels in each motor housing and valve housing. The rotary section valve 56 is contained within a valve housing 174 mounted in a recess in the rotary section. The rotary section valve comprises a spool type valve with both the spool and the valve housing constructed of tungsten carbide to provide long life. This rotary section valve and its related components for applying rotational forces when making changes in azimuth angle are referred to herein as a rotator actuator.

A filter/diffuser 173 is contained within the motor housing, and drilling fluid passes through the drive shaft via a multiplicity of holes and into the filter/diffuser. Drilling fluid from the flex section valve 40 moves through flow passages through a valve housing 175 to the deflection housing 132, thereby pressurizing the flex piston 136. The flex valve housing is mounted in a recess in the rotary section opposite from the rotary valve housing. The flex section valve 40 is a spool type valve made tungsten carbide. Fluid returning from the deflection housing is discharged to the annulus between the steering tool and the wall of the borehole.

Figure 15:
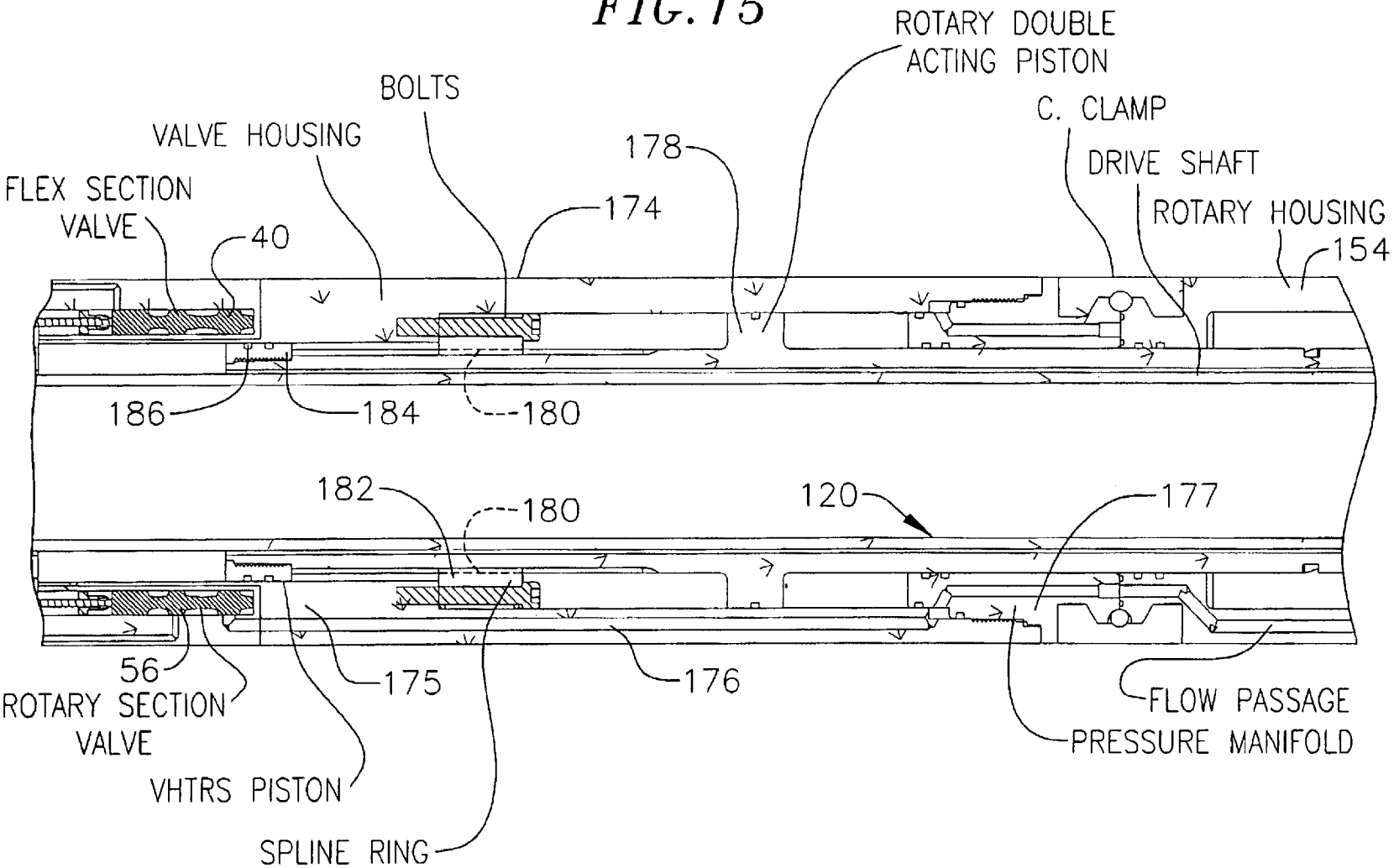
FIG. 15 is an enlarged fragmentary cross-sectional view taken within the circle 15—15 of FIG. 12.
Figure 16:
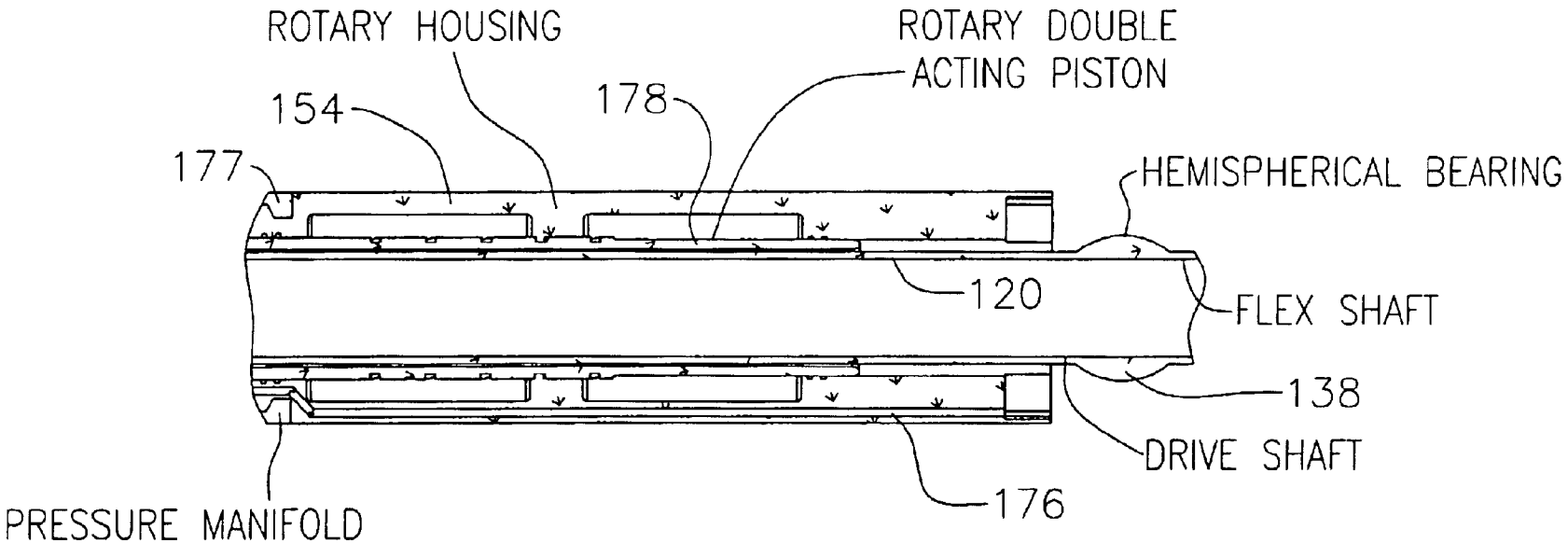
FIG. 16 is an enlarged fragmentary cross-sectional view taken within the circle 16—16 of FIG. 12.

Referring to FIGS. 15 and 16, drilling fluid from the rotary section valve 40 passes via fluid flow passages 176 through the rotary valve housing 175 and into either side (as directed by the valve) of the region of a rotary double-acting piston 178. Drilling fluid from the other side of the piston 178 returns via fluid passageways to the rotary valve 56 and is discharged to the annulus. Drilling fluid also passes through flow passages 176 via a pressure manifold 177 to the rotary housing and then to the deflection housing. The aft end of the rotary double-acting piston has splines 180 connected to a spline ring 182. The splines restrict motion of the rotary double-acting piston (and its shaft) to strictly linear motion. The aft end of the rotary double-acting piston is sealed from the drilling fluid by a piston 184 (referred to as valve housing to rotary section piston or VHTRS piston). The VHTRS piston includes piston seals 186, and this piston provides a physical closure for the area between the valve housing and the rotary section. As the rotary double-acting piston 178 moves forward linearly, its helical teeth engage matching helical grooves in the rotary housing 154. The helical teeth or gears on the rotary double-acting piston are shown at 188 in FIG. 17. The rotary housing is connected via recessed teeth to the deflection housing and the deflection housing cap. Pressurized drilling fluid delivered to the rotary double-acting piston results in rotation of the deflection housing, thus changing the steering tool's azimuth position.

Figure 17:
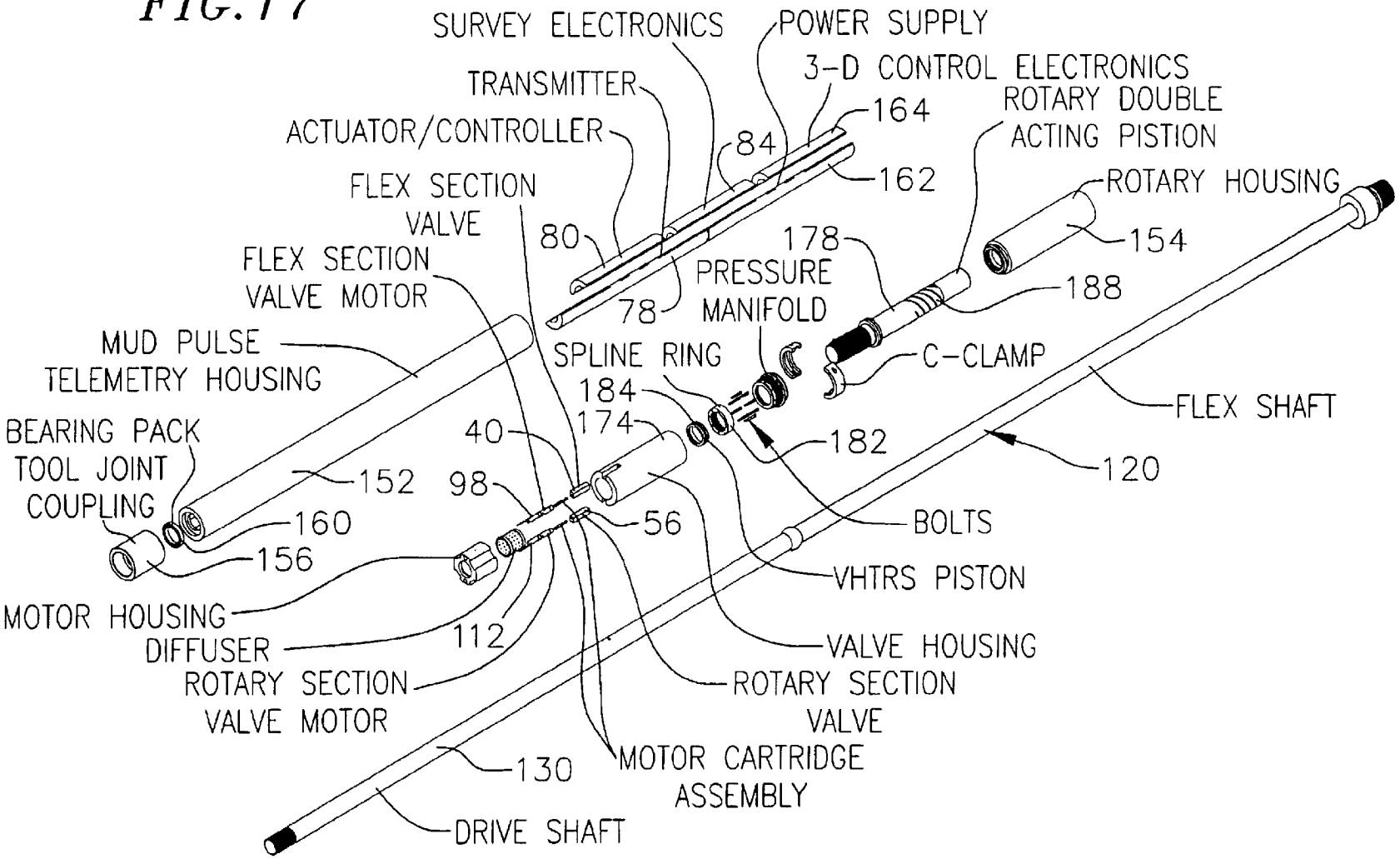
FIG. 17 is an exploded perspective view illustrating internal components of an onboard telemetry section, flex section and rotary section of the steering tool.

The perspective view of FIG. 17 shows components of the three-dimensional steering tool as described above to better illustrate the means of assembling them into an integrated unit.

The rotary section achieves changes in the azimuth by the following method. At the surface, a signal is sent to the tool via the mud pulse telemetry section. The mud pulse telemetry section receives the mud pulse, translates the pulse into electrical instructions and provides an electrical signal to the 3-D control electronics. (Pressurization and actuation of the flex piston has been described previously. Both the rotary and flex sections are pressurized and actuated simultaneously for the steering tool to produce both azimuth and inclinational changes.) The 3-D electrical controls provide an electrical signal to either or both of the electric motors for the rotary and the flex section valves. When the rotary valve is actuated, fluid from the bore passes through the filter and into the valve that delivers drilling fluid to the double-acting piston. The double-acting piston is moved forward for driving the helical gears connected via a coupling to the deflection housing, which rotates relative to the flex shaft. The position of the double-acting piston allows positioning from zero to 360 degrees in clockwise or counter-clockwise rotation, thus changing the orientation of the deflection housing relative to the skin (which is resting on the hole wall thus providing a reaction point). Drilling fluid under pressure is delivered to the flex section and azimuthal change begins as follows. (Drilling fluid under pressure can be applied via the method described to the reverse side of the double-acting piston to re-position the housing in a counter-clockwise orientation.)

After the tool has drilled ahead enough to allow the drill string to follow the achieved azimuth, the valve changes position, the double-acting piston receives drilling fluid, the flex piston is returned to neutral, and straight drilling resumes.

The present invention can be applied to address a wide range of drilling conditions. The steering tool can be made to operate in all typical hole sizes from 2⅞ inch slim holes up to 30-inch holes, but is particularly designed to operate in the 3¾-inch up to 8¾-inch holes. The tool length is variable, but typically is approximately 20 feet in length. The tool joint coupling and threaded end of the flex shaft can have any popular oil field equipment thread such as various American Petroleum Institute (API) threads. Threaded joints can be made up with conventional drill tongs or similar equipment. The tool can withstand a range of weight on bit up to 60,000 pounds, depending upon tool size. The inside diameter of the drive shaft/flex shaft can be range from 0.75 to 3.0 inches to accommodate drilling fluid flow rates from 75–650 gallons per minute. The steering tool can operate at various drilling depths from zero to 32,000 feet. The steering tool can operate over a typical operational range of differential pressure (the difference of pressure from the ID of the steering tool to outside diameter of the tool) of about 600 to 3,500 PSID, but typically up to about 2,000 PSID. The size of the drive shaft/flex shaft can be adjusted to accommodate a range of drilling torque from 300 to 8,000 ft-lbs. depending upon tool size. The steering tool has sufficient strength to survive impact loads to 400,000 lbs. and continuous absolute overpull loads to 250,000 lbs. The tool's drive shaft can operate over the typical range of rotational speeds up to 300 rpm.

In addition, the rotary section and flex section require little drilling fluid. Because the rotary section drilling fluid system is of low volume, the operation of the rotary section requires from less than 4 GPM to operate. The flex section is also a low volume system and can operate on up to 2 GPM. Thus, the steering tool can perform its function with up to 6 GPM, which is from 1 to 5% of the total drilling fluid flowing through the tool.

For the rotary section, the velocity of the rotary double-acting piston can range from 0.002 inches per minute to up to 8 inches per minute depending upon the size of the piston, flow channel size, and helical gear speed.

The steering tool control section includes a helical screw position sensor or potentiometer (not shown), as well as the previously described mud pulse telemetry actuator/controller electronics, survey electronics, 3-D control electronics, power supply, and transmitter.

One type of flex position transducer can be a MIDIM (mirror image differential induction-amplitude magetometer). With this design, a small magnetic source is placed on the flex piston or the rotary double acting piston and the MIDIM (manufactured by Dinsmore Instrument Company, 1814 Remell St. Flint, Mich. 48503) within the body of the deflection housing or the rotary housing, respectively. As the magnetic source moves as a result of the pressure on the piston, a calibrated analog output provides continuous reading of displacement. Other acceptable transducers that use the method described above include a Hall effect transducer and a fluxgate magnetometer, such as the ASIC magnetic sensor available from Precision Navigation Inc., Santa Rosa, Calif.

The mud pulse telemetry section provides the control information to the surface. These systems are commercially available from such companies as McAllister-Weatherford Ltd. of Canada and Geolink, LTD, Aberdeen, Scotland, UK as are several others. Typically these systems are housed in 24 to 60-inch long, 2⅞ to 6¾-inch outside diameter, 1 to 2 inch inside diameter packages.

Included in the telemetry section is a mud pulse transmitter assembly that generates a series of mud pulses to the surface. The pulses are created by controlling the opening and closing of an internal valve for allowing a small amount of drilling fluid volume to divert from the inside the drill string to the annulus of the borehole. The bypassing process creates a small pressure loss drop in the standpipe pressure (called negative mud pulse pressure telemetry). The transmitter also contains a pressure switch that can detect whether the mud pumps are switched on or off, thus allowing control of the tool.

The actuator/controller regulate the time between transmitter valve openings and the length of the pulse according to instructions from the survey electronics. This process encodes downhole data to be transmitted to the surface. The sequence of the data can be specified from the surface by cycling the mud pumps in pre-determined patterns.

The power supply contains high capacity lithium thionyl chloride batteries or similar long life temperature resistance batteries (or alternatively a downhole turbine and electrical generator powered by mud).

The survey electronics contain industry standard triaxial magnetometers and accelerometers for measuring inclination (zero to 180 degrees), and azimuth (zero to 360 degrees) and tool face angle (zero to 360 degrees). Tool face angle is the orientation of the tool relative to the cross-section of the hole at the tool face. Included are typically microprocessors linked to the transmitter switch that control tool functions such as on-off and survey data. Other types of sensors may also be placed in the assembly as optional equipment. These other sensors include resistivity sensors for geological formation information or petroleum sensors.

The data are transmitted to the surface computer system (not shown). At the surface, a transmitter and receiver transmits and receives mud pulses, converts mud pulses to electrical signals, discriminates signal from noise of transmissions, and with software graphically and numerically presents information.

The surface system can comprise a multiplexed device that processes the data from the downhole tool and also directs the information to and from the various peripheral hardware, such as the computer, graphics screen, and printer. Also included can be signal conditioning and intrinsic safety barrier protections for the standpipe pressure transducer and rig floor display. The necessary software and other hardware are commercially available equipment.

Instructions from the mud pulse telemetry section are delivered to the 3-D control electronics, (the electrical control and feedback circuits described in the block diagrams). The 3-D control electronics receive and transmit instructions to and from the actuator/controller to provide communication and feedback to the surface. The 3-D steering electronics also communicate to the rotary position sensor and the flex position sensor. A feedback circuit (as described in the block diagram of FIG. 4) provides position information to the 3-D steering tool electronics.

Thus, changes in direction are sent from the surface to the steering tool through the surface system, to the actuator/controller, to the 3-D steering electronics, and to the electric motors of the rotary and flex section valves that move either the flex piston or rotary double-acting piston. The new position of the piston is measured by the sensor, compared to the desired position, and corrected if necessary. Drilling continues with periodic positional measurements made by the survey electronics, sent to the actuator/controller to the transmitter, and then to the surface, where the operator can continue to steer the tool.

The electrical systems are designed to allow operation within downhole pressures (up to 16,000 PSI). This is typically accomplished with atmospheric isolation of electrical components, specially designed electrical connectors that operate in the drilling environments, and thermally hardened electronics and boards.

The steering tool can include an optional flex toe gripper whose purpose is to ensure a fixed location of the tool to an azimuth orientation. When the flex toe is activated it grips the wall of the borehole for making changes in inclination and/or azimuth. The flex toe design includes flex elements that are pinned at one end and slide on the opposite end. Underneath the flex elements are inflatable bladders that are filled with drilling fluid when pressurized and collapse when depressurized. Drilling fluid is delivered to the bladder via a motorized valve, typically the rotary valve described previously. The valve is controlled in a manner similar to the motorized valves for the flex section or rotary section via mud pulse telemetry or similar means.

The flex toe is optional depending upon the natural tendency for the 3-D steering tool's skin not to rotate; it can be provided as an option to resist minor twisting of the drill string and maintain a constant reference for the tool motion.

In a similar manner to the flex toe, a packerfoot (shown schematically in FIG. 3) can be utilized in the steering tool as a mechanism to provide a reaction point for the rotary section when simultaneously changing inclination and azimuth while drilling. The packerfoot developed by Western Well Tool is described in U.S. Pat. No. 6,003,606, the entire disclosure of which is incorporated herein by reference. The packerfoot can be either rigidly mounted or can be allowed to move on a mandrel. When connected to a mandrel the packerfoot provides resistance to rotation but without dragging the packerfoot over the hole wall.

Specific types of materials are required for parts of the steering tool. Specifically, the shaft and flex piston must be made of long fatigue life material with a modulus lower than the skin and housing. Suitable materials for the shaft and flex piston are copper-beryllium alloys (Young's modulus of 19 Million PSI). The tool's skin and housing can be various steel (Young's modulus of 29 Million psi) or similar material.

Specialized sealing materials may be required in some applications. Numerous types of drilling fluids are used in drilling. Some of these, especially oil-based mud or Formate muds are particularly damaging to some types of rubbers such as NBR, nitrile, and natural rubbers. For these applications, use of specialized rubbers such as tetraflourethylene/propylene elastomers provides greater life and reliability.

The tool operates by means of changes in inclination or by changes of azimuth in separate movements, but not necessarily both simultaneously. Typical operation includes drilling ahead, telemetry to the 3-D steering tool, and changes in the orientation of the drill bit, followed by change in the inclination of the bore hole. The amount of straight hole drilled before changes in inclination can be as short as the length of the 3-D steering tool.

For azimuthal changes, drilling ahead continues (with no inclination), telemetry from the surface to the tool with instruction for changes in azimuth, internal tool actions, followed by change in the azimuth of the bore hole.

Other instruments can be incorporated into the steering tool, such as Weight-on-Bit, Torque-on-Tool, bore pressure, or resistivity or other instrumentation.

What is claimed is:

1. A three-dimensional steering tool for use in drilling a borehole in an underground formation in which an elongated conduit extends from the surface through the borehole and in which the steering tool is mounted on the conduit near a drill bit for drilling the borehole, the steering tool comprising an integrated telemetry section, rotary section and flex section aligned axially along the steering tool for separately controlling inclination and azimuth angles at the drill bit; in which the flex section includes an elongated drive shaft coupled to the drill bit and adapted to be rotatably driven for rotating the drill bit, the drive shaft being bendable laterally to define a deflection angle thereof, and a deflection actuator coupled to the drive shaft, the deflection actuator comprising a deflection housing surrounding the drive shaft and having a longitudinal axis and an elongated deflection piston movable in the deflection housing for applying a lateral bending force to the drive shaft for making changes in the deflection angle of the drive shaft and which is transmitted to the drill bit as an inclination angle steering adjustment; in which the rotary section is coupled to the actuator and includes a rotator actuator for transmitting a rotational force to the deflection actuator to rotate the deflection piston to thereby change the rotational angle at which the lateral bending force is applied to the drive shaft which is transmitted to the drill bit as an azimuth angle steering adjustment; and in which the telemetry section measures the inclination angle and the azimuth angle during drilling and compares them with desired inclination and azimuth angle information to produce inclination control signals for operating-the deflection actuator to make steering adjustments in the inclination angle and for separately producing azimuth control signals for operating the rotator actuator for making steering adjustments in the azimuth angle.

2. Apparatus according to claim 1 in which the conduit is an elongated rotary drill string.

3. Apparatus according to claim 1 in which the deflection actuator comprises an elongated deflection housing surrounding the drive shaft, and an elongated hydraulically operated piston in the deflection housing for applying the bending force distributed lengthwise along the drive shaft for flexing the drive shaft laterally to produce said deflection angle thereof to thereby change the inclination angle at the drill bit.

4. Apparatus according to claim 3 in which the rotator actuator is coupled to the deflection housing and includes a rotator piston movable in proportion to a desired change in the azimuth angle and a helical gear arrangement on the deflection housing coupled to the rotator piston and rotatable in response to piston travel to rotate the deflection housing to change the azimuth angle at the drill bit.

5. Apparatus according to claim 1 in which the hydraulically powered bending force is applied to the deflection piston by drilling mud taken from an annulus between the conduit and the borehole.

6. Apparatus according to claim 1 in which the deflection actuator applies the bending force to the drive shaft while the rotary actuator applies the rotational force to the deflection actuator for making simultaneous adjustments in the inclination angles and the azimuth angles.

7. Apparatus according to claim 1 in which the feedback loop comprises a closed loop controller including a comparator for receiving the measured and desired inclination angle and azimuth angle command signals for producing inclination and azimuth error signals for making the steering adjustments.

8. Apparatus according to claim 1 in which the telemetry section comprises an onboard mud pulse telemetry section for receiving the desired inclination and azimuth angle input signals and utilizing mud pulse controls for operating the deflection actuator and the rotator actuator from drilling mud taken from an annulus between the conduit and the borehole.

9. The apparatus according to claim 8 in which the mud pulse telemetry section provides open loop control to the deflection actuator and the rotator actuator, and in which electrical controls provide closed loop control to the actuators.

10. Apparatus according to claim 1 in which the deflection actuator includes axially spaced-apart end bearings for mounting the drive shaft along a longitudinal axis of the steering tool, and a deflection piston for applying the lateral bending force to the drive shaft between the end bearings to bend the drive shaft while the end bearings constrain the drive shaft on opposite sides of the deflection piston.

11. Apparatus according to claim 1 in which the deflection piston contained in the deflection housing is positioned on one side of the drive shaft and the drive shaft has a longitudinal axis aligned with a longitudinal axis of the deflection housing, and the lateral bending force is applied by the piston as a unitary force which physically bends the drive shaft to deflect its longitudinal axis away from the axis of the deflection housing.

* * * * *